US008726558B1

(12) United States Patent
Nason

(10) Patent No.: US 8,726,558 B1
(45) Date of Patent: May 20, 2014

(54) AR-15 HANDGUARD SYSTEM

(75) Inventor: John Paul Nason, Tacoma, WA (US)

(73) Assignee: Aero Precision, Inc., Tacoma, WA (US)

( * ) Notice: Subject to any disclaimer, the term of this patent is extended or adjusted under 35 U.S.C. 154(b) by 186 days.

(21) Appl. No.: 13/374,869

(22) Filed: Jan. 17, 2012

Related U.S. Application Data

(63) Continuation-in-part of application No. 29/349,427, filed on Mar. 31, 2010, now abandoned.

(60) Provisional application No. 61/461,477, filed on Jan. 18, 2011.

(51) Int. Cl.
*F41C 23/00* (2006.01)

(52) U.S. Cl.
USPC ..... 42/71.01

(58) Field of Classification Search
USPC ..... 42/71.01, 72, 124
See application file for complete search history.

(56) References Cited

U.S. PATENT DOCUMENTS

| | | | | |
|---|---|---|---|---|
| 4,536,982 | A | 8/1985 | Bredbury et al. | |
| 4,663,875 | A | 5/1987 | Tatro | |
| 5,198,600 | A | 3/1993 | E'Nama | |
| 7,231,861 | B1 | 6/2007 | Gauny et al. | |
| 7,669,359 | B2 * | 3/2010 | Kim | 42/124 |
| 7,753,679 | B1 | 7/2010 | Schuetz | |
| 7,798,045 | B1 | 9/2010 | Fitzpatrick et al. | |
| D639,376 | S * | 6/2011 | Ding | D22/108 |
| D644,294 | S * | 8/2011 | Clary | D22/108 |
| 8,020,334 | B2 * | 9/2011 | Delmonico | 42/105 |
| 8,276,304 | B2 * | 10/2012 | Samson et al. | 42/75.02 |
| D673,239 | S * | 12/2012 | Cheng | D22/109 |
| 8,505,228 | B2 * | 8/2013 | Cheng | 42/90 |
| 2005/0241211 | A1 | 11/2005 | Swan | |
| 2005/0268513 | A1 | 12/2005 | Battaglia | |
| 2006/0010748 | A1 * | 1/2006 | Stoner et al. | 42/71.01 |
| 2006/0026883 | A1 | 2/2006 | Hochstrate et al. | |
| 2006/0236582 | A1 | 10/2006 | Lewis et al. | |
| 2007/0006509 | A1 * | 1/2007 | DeSomma et al. | 42/72 |
| 2007/0017139 | A1 | 1/2007 | Larue | |
| 2008/0092422 | A1 | 4/2008 | Daniel et al. | |
| 2010/0154280 | A1 * | 6/2010 | LaFrance et al. | 42/124 |
| 2010/0236395 | A1 | 9/2010 | Akhavan | |

* cited by examiner

*Primary Examiner* — Michelle Clement
(74) *Attorney, Agent, or Firm* — Lowe Graham Jones PLLC

(57) ABSTRACT

An aftermarket handguard system is described for use with an assault rifle, such as an AR-15. The system includes an elongated arcuate upper handguard section substantially defining a longitudinal axis and a plurality of radial planes normal thereto. The handguard section has left and right generally outward directed rail flanges having non-parallel flange mating surfaces. Two lower arcuate handguard sections are provided also each having laterally extending rail flanges with non-parallel flange mating surfaces. Three "T" shaped accessory rails each having a dovetail shaped portion are provided for mating to the non-parallel flange mating surfaces. Accessories may be mounted on the accessory rails in the conventional manner.

20 Claims, 6 Drawing Sheets

AR-15 HANDGUARD SYSTEM

CROSS REFERENCE TO RELATED APPLICATION

This non-provisional application claims the benefit of the filing dated of provisional application Ser. No. 61/461,477 filed on Jan. 18, 2011 entitled "AR 15 HANDGUARD SYSTEM" under 35 U.S.C. §119(e). This application is also a continuation-in-part of U.S. Design patent application Ser. No. 29/349,427, filed Mar. 31, 2010 now abandoned and claims the benefit of the filing date thereof in accordance with 35 U.S.C. §120.

TECHNICAL FIELD

This invention generally relates to rifle accessories. More specifically, the invention relates to aftermarket handguards for AR-15 rifles and the like.

BACKGROUND OF THE INVENTION

The M16 is a lightweight, 5.56 mm, air cooled, gas operated, magazine fed assault rifle with a rolling bolt, actuated by direct impingement gas operation. The rifle is made from steel, aluminum, and composite plastic and polymer materials, and is the primary assault weapon for the United States military. The M16 entered U.S. Army service as the M16 A1 in South Vietnam in 1963 replacing the M14 rifle. Colt Industries, Inc. purchased the rights to manufacture a civilian version of the M16 (designated AR-15) from ArmaLite and currently uses the AR-15 designation only for semi-automatic versions of the M16 rifle. The AR-15 semi-automatic assault rifle has become very popular with hobbyists and gun collectors in the United States. The rifle serves various purposes from target shooting to hunting to varmint control. In that regard it has become a very popular to modify the AR-15 with a variety of accessories such as hunting rifle telescopic sights, bipods, infrared illuminators and night vision telescopic sights. In order to accommodate these accessories, the standard issue thermal setting plastic handguard on the AR-15 can be replaced by a variety of aftermarket milled aluminum multi-section handguards having accessory rails for mounting said accessories.

The following prior art patents are believed to be material and relevant to the examination of this application:

| Pat. No. | Publication Date | Name |
|---|---|---|
| US2005/0241211 | Nov. 3, 2005 | Swan |
| US2005/0268513 | Dec. 8, 2005 | Battaglia |
| US2006/0026883 | Feb. 9, 2006 | Hochstrate et al. |
| US2006/0236582 | Oct. 26, 2006 | Lewis et al. |
| US2007/0017139 | Jan. 25, 2007 | Larue |
| US2008/0092422 | Apr. 24, 2008 | Daniel et al. |
| 4,536,982 | Aug. 27, 1985 | Bredbury et al. |
| 4,663,875 | May 12, 1987 | Tatro |
| 5,198,600 | Mar. 30, 1993 | E'Nama |
| 7,231,861 | June 2007 | Gauny et al. |
| 7,753,679 | July 2010 | Schuetz, Brian D. |
| 7,798,045 | September 2010 | Fitzpatrick et al. |
| US2010/0236395 | Sep. 23, 2010 | Akhavan |

These prior art handguards are often multi-segmental. Thus such accessory handguards are often difficult to machine to sufficiently high standards and tolerances such that unsightly gaps do not develop between mating surfaces while the handguards go through dramatic thermocycling during operation of the rifle.

Thus, a need exists for a handguard system for the AR-15 civilian assault rifle which is tolerant of minor size fluctuations and thermal expansions/contractions cycles without visible gaps in mating surfaces.

SUMMARY OF THE INVENTION

The invention comprises an aluminum handguard for an AR-15 rifle or the like. The handguard includes arcuate sections interconnected by at least two accessory rail portions having key stone or dovetail shaped bases. The bases mate with corresponding angled accessory rail flanges on the sections, such as by bolts. "T" shaped heads on the rails hide the interfaces therebetween. The angled mating surfaces allow for looser machining tolerances and expansion/contraction of the mating surfaces due to heating/cooling cycles do not cause the mating surfaces to separate or bind.

DETAILED DESCRIPTION OF THE PREFERRED EMBODIMENTS

Figure 1:
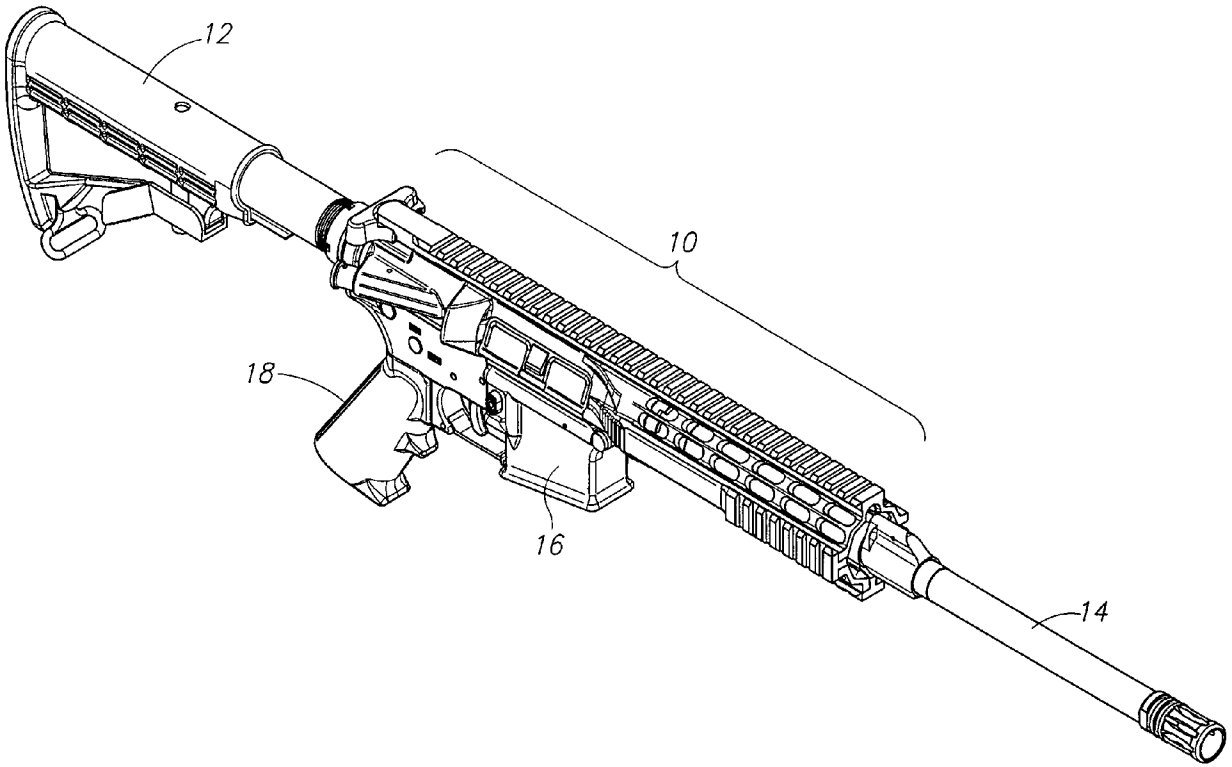
FIG. 1 is a top right perspective view of my invention in use on an AR-15 rifle.
Figure 2:
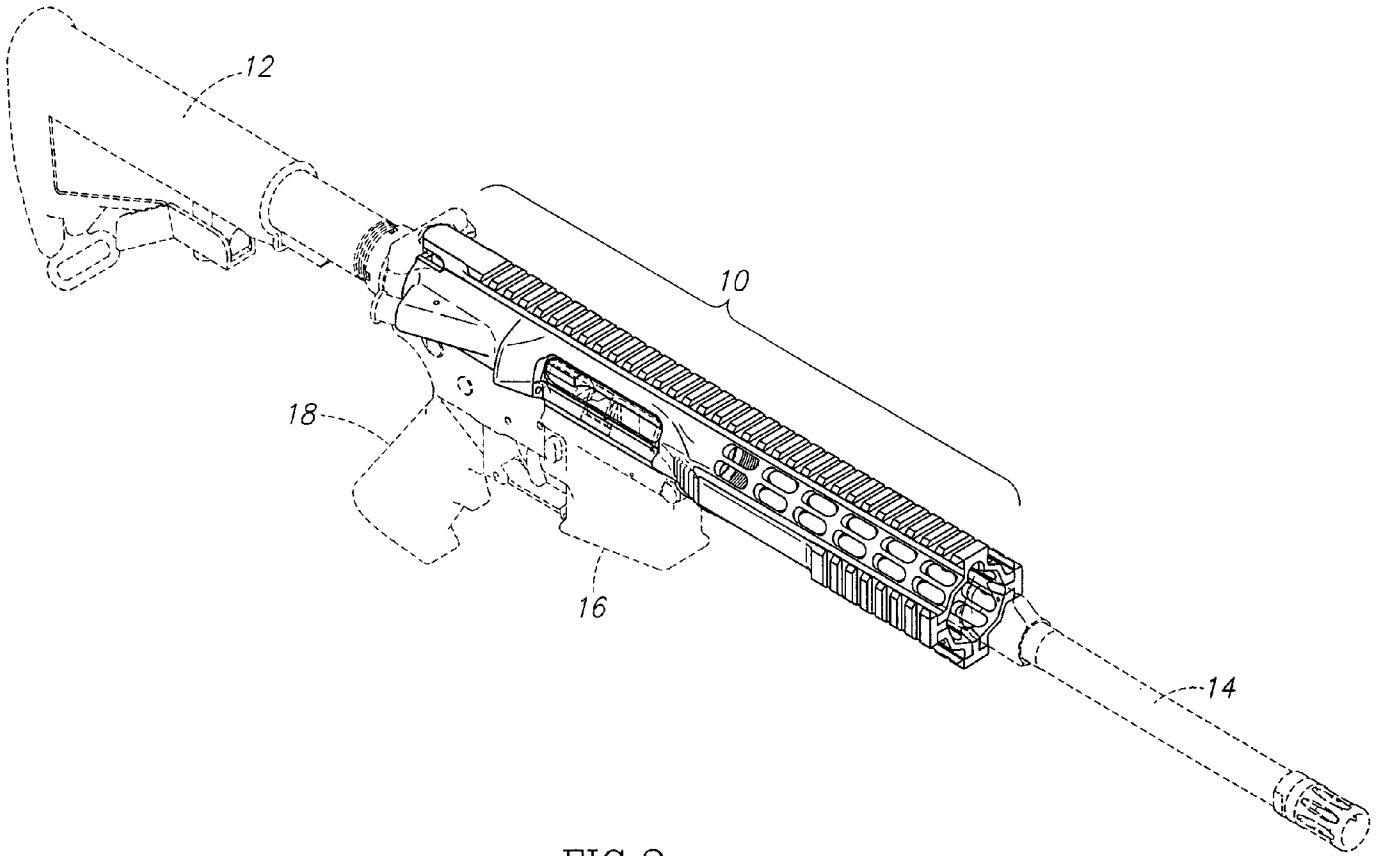
FIG. 2 is a top, right environmental perspective view of my invention in use with the AR-15 rifle shown in dashed lines.
Figure 3:
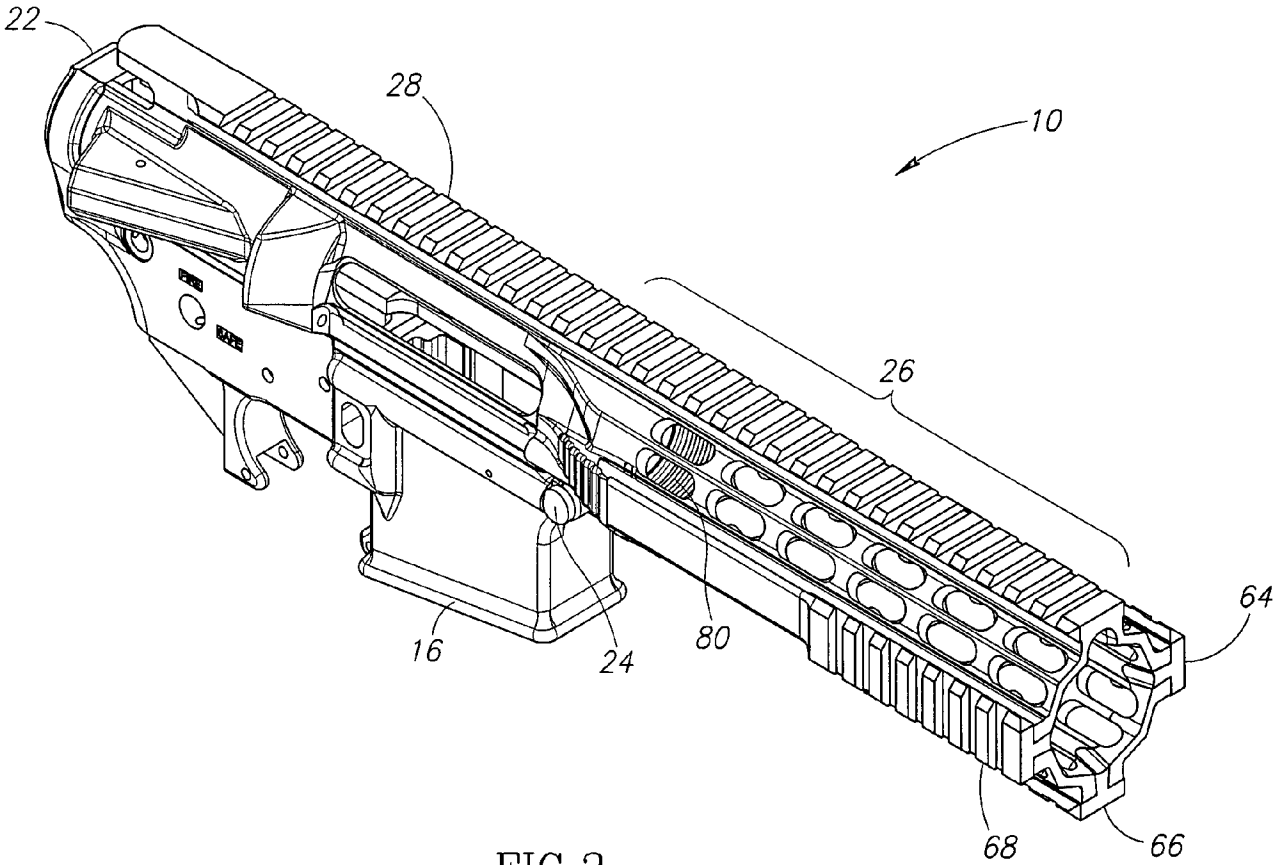
FIG. 3 is a top, right isometric view of the assembled invention, including a lower receiver.
Figure 4:
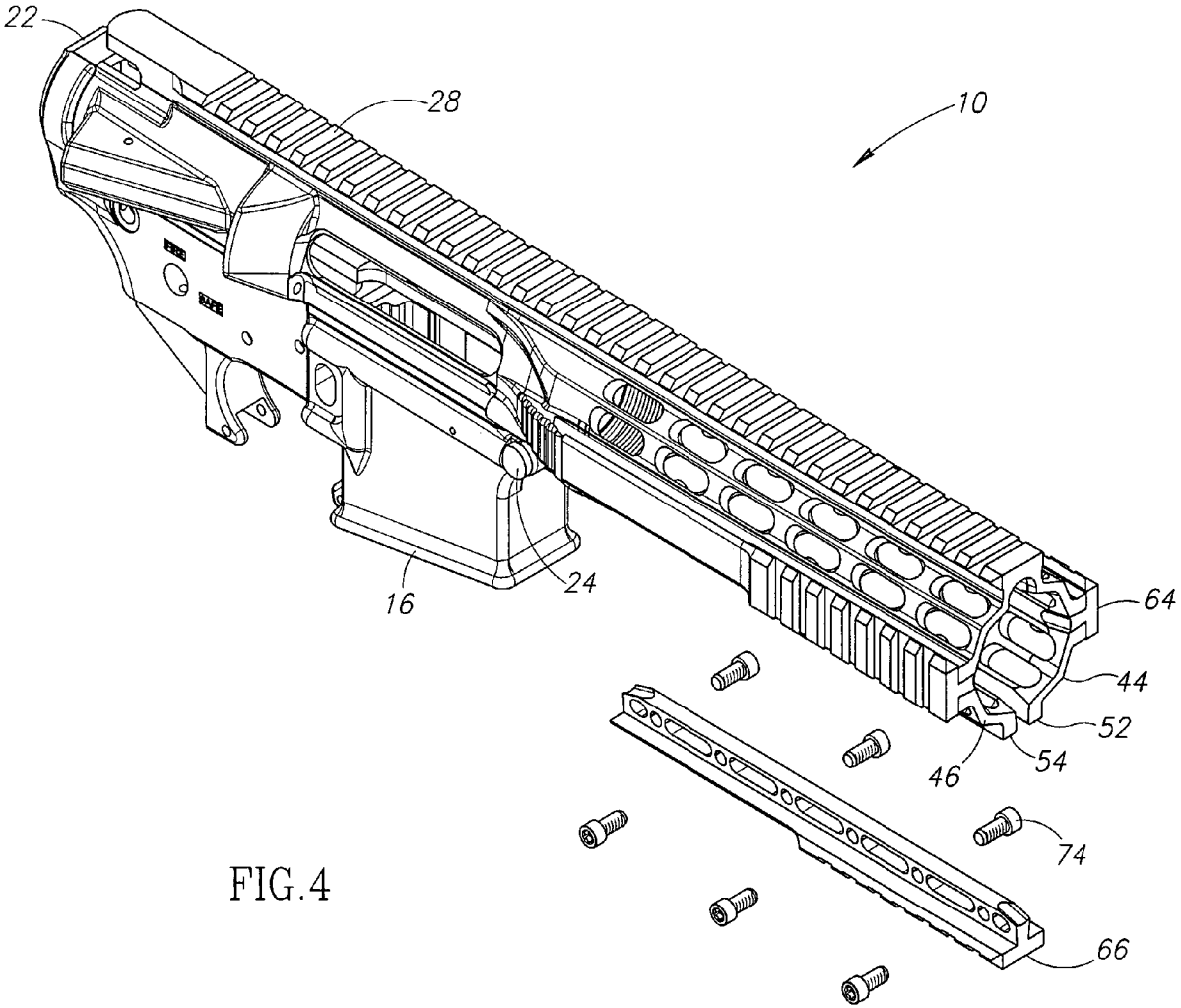
FIG. 4 is an exploded view similar to FIG. 3.
Figure 5:
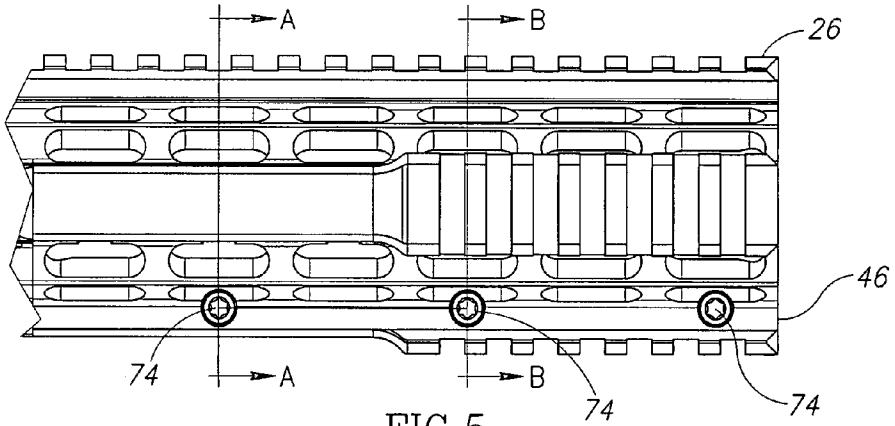
FIG. 5 is a left side dimensional view (partial) of my invention.
Figure 6B:
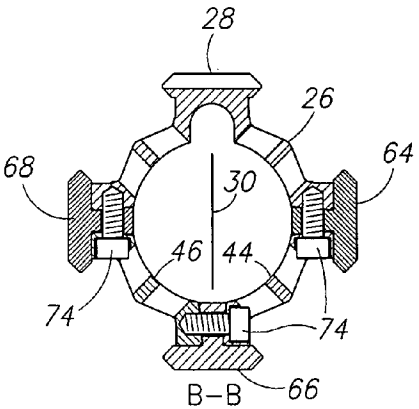
FIG. 6B a sectional view taken along line B-B of FIG. 5.
Figure 6A:
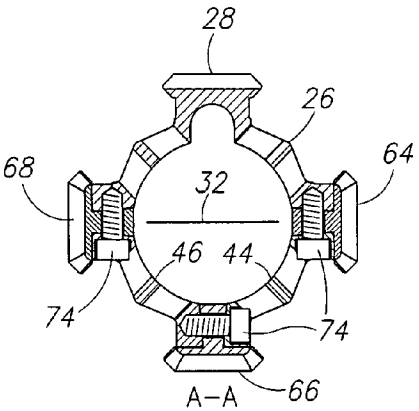
FIG. 6A is a sectional view taken along line A-A of FIG. 5.
Figure 7:
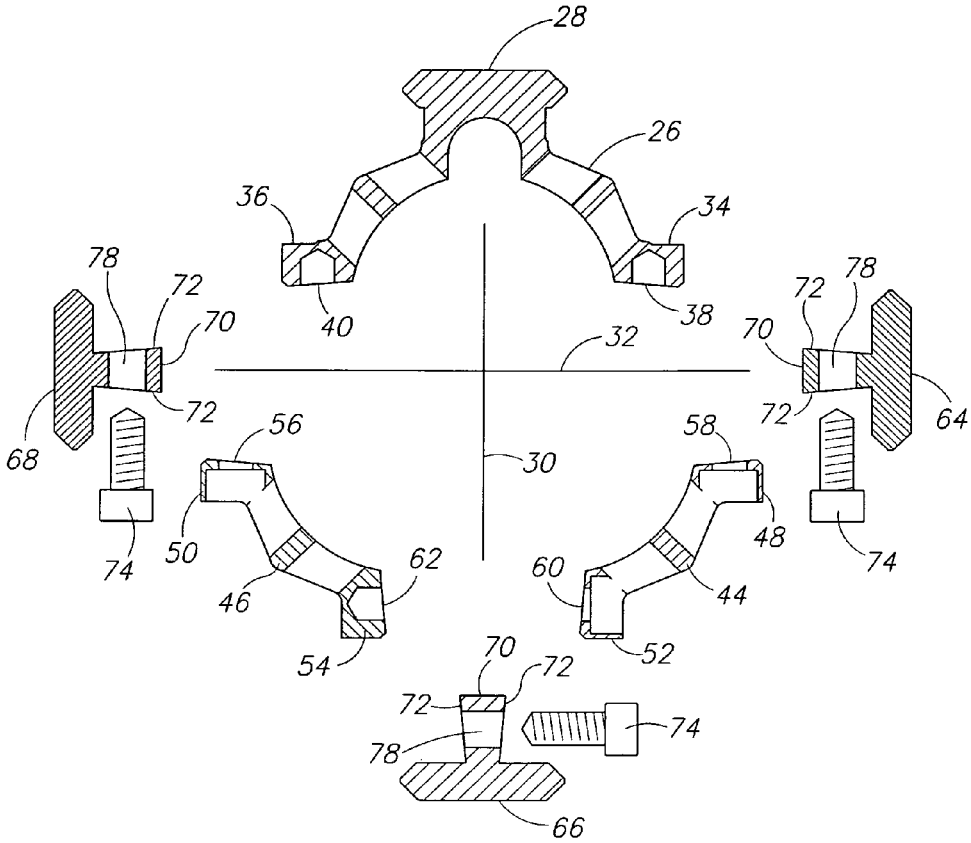
FIG. 7 is an exploded schematic representation of my invention.

An aftermarket handguard system in accordance with the principals of the inventions is generally shown at reference numeral 10 in the various Figures in the attached drawings wherein numbered elements in the Figures correspond to like numbered elements herein. This invention is specifically adapted for use with a civilian AR-15 type semi-automatic assault rifle of the type consisting of butstock 12, a barrel 14, a lower receiver 16 and a pistol grip 18. Those elements are of the conventional type and are shown in dotted lines in FIG. 2, and in solid lines in FIG. 1. The inventive aftermarket handguard system 10 is shown in FIG. 3 along with a conventional removable lower receiver 16 for purposes of clarity. The lower receiver 16 is connected to a unitary upper receiver 22 such as by pins 24 in the conventional manner. The upper receiver is preferably unitary and includes an arcuate upper handguard section 26 including an elongated, ribbed upper accessory rail 28. As best seen in FIGS. 6A and 6B, the receiver 22 defines an elongated axis, and a plurality of radial planes such as vertical radial plane 30 and horizontal radial plane 32. As best seen in FIG. 7, the upper handguard section 26 terminates laterally in left and right generally outwardly directed rail flanges 34, 36, each flange having an associated planar flange mating surface 38, 40. The mating surfaces 38, 40 however are not disposed substantially parallel to the horizontal radial plane 32, but rather form an angle therewith of approximately 15°. Nevertheless, the upper handguard section subtends a radial angle of approximately 180°.

In order to complete the handgrip, left and right lower arcuate handguard sections 44, 46 each subtending angle of approximately 90° are also provided. Each lower handguard section has substantially laterally extending rail flanges 48, 50 and downwardly depending rail flanges 52, 54. Each laterally extending rail flange 48, 50 has substantially non-parallel lateral flange mating surfaces 56, 58; with each surface again deviating from the horizontal radial plane 32 by approximately 15°. Each downwardly depending rail flange 52, 54 similarly has substantially non-parallel vertical flange mating surfaces 60, 62 which deviate from the vertical radial plane 30 also by approximately 15°.

To complete the system, three substantially "T" shaped accessory rails 64, 66, 68 are provided at the three o'clock, six o'clock, and nine o'clock positions with respect to the radial planes 30, 32 as shown in FIG. 7. Each "T" shaped accessory rail has a stem portion having opposed, diverging non-parallel side walls adapted to be closely received by the mating surfaces of the rail flanges. That is, the T-shaped accessory rails 64 have stem portions 70 which resemble dovetails, with the sidewall 72 deviating from the corresponding radial plane also by approximately 15°. When fully assembled as shown in FIGS. 6A and 6B, the opposed mating surfaces on the flanges form mortises for the dovetail shaped tenons formed by the stem portions 70. Conventional set screws 74 are provided to bind the system together through corresponding bores and receptacles in the flanges 34, 36, 48, 50, 52 and 54. The accessory rails 64 also have corresponding bores 78 for passage therethrough of set screw 74.

It will be apparent to those of ordinary skill in the art that by providing a mortise and tenon type arrangement for the accessory rails, handguard lower sections and upper handguard section that expansion and contraction of the system 10 due to thermal stresses can cause the various surfaces to slide relative to one another minutely without creating gaps therebetween. Furthermore, the mating surfaces of the system are hidden by heads on the stem portions 70 of the accessory rails 64, 66 and 68 which provide mounting structures for a variety of accessories in the conventional fashion.

In this regard, the handguard system 10 is unique in its construction in that the accessory rails 64, 66 and 68 are not fastened to a separate support structure but form their own support structure. This dovetailed design allows a compact yet strong structure which is reasonably easy to manufacture yet is tolerant of minor size fluctuations without visible gaps in mating surfaces. The aftermarket handguard system 10 includes other improvements with respect to the conventional handguard system for the AR-15. By way of example and not limitation, the unitary upper receiver 22 includes threads 80 which are external to the barrel 14 of the AR-15, whereas the conventional design is a reverse structure. The upper section 22 is notched to accommodate the index pin of any barrel using the standard ex-M16 barrel extension interface. The invention is provided with an externally threaded barrel nut (not shown) which allows the barrel mounting feature to be greatly strengthened compared to the conventional prior art design. The unitary upper receiver section 22 also includes a fully enclosed dust cover pin support which can be accessed when the lower receiver sections 44, 46 are removed. That pin is designed to be hooked and drawn out with no further disassembly, which is an improvement over the original M16 design which requires removal of the barrel nut pin.

The upper receiver 22, lower sections 44, 46 and accessory rails 64,66, and 68 are preferably manufactured from heat treated aluminum such as Temper T6, 7075.

Those of ordinary skill in the art will conceive of other alternate embodiments of the invention upon review of this disclosure. Thus, the invention is not to be limited to the above description, but is to be determined in scope by the claims which follow.

I claim:

1. An aftermarket hand guard system for use with an assault rifle, comprising:

a unitary upper receiver and elongated, arcuate upper hand guard section substantially defining a longitudinal axis and a plurality of radial planes normal thereto, the hand guard section laterally terminating in left and right generally outwardly directed rail flanges, each flange having a substantially planar flange mating surface;

a plurality of lower arcuate hand guard sections, each having a plurality of laterally extending rail flanges having substantially non-parallel flange mating surfaces when juxtapositioned with respect to a corresponding rail flange;

a plurality of substantially "T" shaped accessory rails each having a stem portion having opposed, diverging, non parallel sidewalls adapted to be closely received by the rail flanges, each stem portion terminating in a transverse head portion adapted to receive hand guard accessories; and, means for securing the accessory rails to the hand guard sections such that when the system is assembled about an assault rifle barrel the rail flange mating surfaces are not substantially parallel to a radial plane that bisects a corresponding accessory rail stem.

2. The aftermarket hand guard system of claim 1, where in the upper hand guard section has an elongated, centrally located dorsal accessory rail adapted to receive hand guard accessories.

3. The aftermarket hand guard system of claim 1, where in the stem portions are configured so as to be dovetail tenons and the juxtapositioned rail flanges form mortises therefore.

4. The aftermarket hand guard system of claim 1, where in the upper hand guard portion is substantially hemi-cylindrical and the lower hand guard sections subtend angles of approximately 90 degrees.

5. The aftermarket hand guard system of claim 1, where in the assembled hand guard system rail flanges and the accessory rail stems sidewalls define complementary angles with respect to a radial plane that bisects a corresponding accessory rail stem of approximately 15 degrees.

6. The aftermarket hand guard system of claim 1, where in the upper receiver and upper hand guard section, and the lower hand guard sections are manufactured from heat treated aluminum alloy.

7. The aftermarket hand guard system of claim 6, where in the aluminum alloy is heat treated to 7075 T6 specifications.

8. The aftermarket hand guard system of claim 1, where in the upper and lower hand guard sections have ventilation slots.

9. The aftermarket hand guard system of claim 1, where in the upper receiver has means for accepting a barrel nut.

10. An aftermarket hand guard system for use with an assault rifle, comprising:

an elongated, arcuate upper hand guard section substantially defining a longitudinal axis and a plurality of radial planes normal thereto, the hand guard section laterally terminating in left and right generally outwardly directed rail flanges, each flange having a substantially planar flange mating surface;

a plurality of lower arcuate hand guard sections, each having a plurality of laterally extending rail flanges having substantially non-parallel flange mating surfaces when juxtapositioned with respect to a corresponding rail flange;

a plurality of substantially "T" shaped accessory rails each having a stem portion having opposed, diverging, non parallel sidewalls forming a dovetail tenon adapted to be closely received by the rail flanges, each stem portion terminating in a transverse head portion adapted to receive hand guard accessories; and, means for securing the accessory rails to the hand guard.

11. The aftermarket hand guard system of claim 10, where in sections are arranged such that when the system is assembled about an assault rifle barrel the rail flange mating surfaces are not substantially parallel to a radial plane that bisects a corresponding accessory rail stem.

12. The aftermarket hand guard system of claim 10, where in the upper hand guard section has an elongated, centrally located dorsal accessory rail adapted to receive hand guard accessories.

13. The aftermarket hand guard system of claim 10, where in the juxtapositioned rail flanges form mortises for the accessory rail stems.

14. The aftermarket hand guard system of claim 10, where in the upper hand guard portion is substantially hemi-cylindrical and the lower hand guard sections subtend angles of approximately 90 degrees.

15. The aftermarket hand guard system of claim 10, where in the assembled hand guard system rail flanges and the accessory rail stems sidewalls define complementary angles with respect to a radial plane that bisects a corresponding accessory rail stem of approximately 15 degrees.

16. The aftermarket hand guard system of claim 10, where in the upper receiver and upper hand guard section, and the lower hand guard sections are manufactured from heat treated aluminum alloy.

17. The aftermarket hand guard system of claim 16, where in the aluminum alloy is heat treated to 7075 T6 specifications.

18. The aftermarket hand guard system of claim 10, where in the upper and lower hand guard sections have ventilation slots.

19. The aftermarket hand guard system of claim 10, where in the upper receiver has means for accepting a barrel nut.

20. An aftermarket hand guard system for use with an assault rifle, comprising:

an elongated, arcuate upper hand guard section substantially defining a longitudinal axis and a plurality of radial planes normal thereto, the hand guard section laterally terminating in left and right generally outwardly directed rail flanges, each flange having a substantially planar flange mating surface;

a plurality of lower arcuate hand guard sections, each having a plurality of laterally extending rail flanges having substantially non-parallel flange mating surfaces when juxtapositioned with respect to a corresponding rail flange;

a plurality of substantially "T" shaped accessory rails each having a stem portion having opposed, diverging, non parallel sidewalls adapted to be closely received by the rail flanges, each stem portion terminating in a transverse head portion adapted to receive hand guard accessories; and, means for securing the accessory rails to the hand guard sections such that when the system is assembled about an assault rifle barrel the rail flange mating surfaces are not substantially parallel to a radial plane that bisects a corresponding accessory rail stem.

* * * * *